US007316421B2

(12) United States Patent
Bailey

(10) Patent No.: US 7,316,421 B2
(45) Date of Patent: Jan. 8, 2008

(54) FILE PAPER RETAINER AND METHOD

(76) Inventor: Debra A. Bailey, 14268 Underclift St., NW., Andover, MN (US) 55304

( * ) Notice: Subject to any disclaimer, the term of this patent is extended or adjusted under 35 U.S.C. 154(b) by 408 days.

(21) Appl. No.: 10/833,969

(22) Filed: Apr. 27, 2004

(65) Prior Publication Data

US 2005/0238417 A1 Oct. 27, 2005

(51) Int. Cl.
*B42D 9/00* (2006.01)
*B42D 5/00* (2006.01)
*B42D 1/00* (2006.01)

(52) U.S. Cl. ..... 281/42; 281/38

(58) Field of Classification Search ..... 281/5, 281/15.1, 33, 20, 42, 44, 45; 402/7, 8, 17, 402/19, 46, 55, 56, 60, 62, 80 R, 80 L, 500, 402/72, 73; 24/67.11, 67.3
See application file for complete search history.

(56) References Cited

U.S. PATENT DOCUMENTS

| | | | | |
|---|---|---|---|---|
| 1,160,237 | A | | 11/1915 | Barnes |
| 1,207,396 | A | | 12/1916 | Gordon |
| 1,212,083 | A | | 1/1917 | Mayfield |
| 1,222,375 | A | | 4/1917 | Exline |
| 1,337,582 | A | | 4/1920 | Barry |
| 1,414,269 | A | | 4/1922 | Froehlingsdorf |
| 1,525,705 | A | | 2/1925 | Turner |
| 1,532,389 | A | | 4/1925 | Dysthe |
| 1,569,986 | A | | 1/1926 | Kurtzeborn |
| 1,635,625 | A | | 7/1927 | Johnson |
| 1,883,035 | A | | 10/1932 | Snively et al. |
| 2,061,492 | A | | 11/1936 | Tolman |
| 2,479,215 | A | | 8/1949 | Dalton |
| 2,565,966 | A | | 8/1951 | Jaffin |
| 2,902,295 | A | | 9/1959 | Slaubaugh |
| 3,416,817 | A | | 12/1968 | Gia-Quinto |
| 3,604,067 | A | * | 9/1971 | Brown ..... 24/67 R |
| 5,152,553 | A | * | 10/1992 | Domingo ..... 281/42 |
| 5,375,885 | A | | 12/1994 | Abercrombie |

FOREIGN PATENT DOCUMENTS

| | | |
|---|---|---|
| DE | 4429122 A1 | 2/1996 |
| JP | 2-26794 | 1/1990 |

* cited by examiner

*Primary Examiner*—Monica Carter
*Assistant Examiner*—Pradeep C Battula
(74) *Attorney, Agent, or Firm*—Merchant & Gould P.C.

(57) ABSTRACT

An apparatus for holding back papers in a folder to facilitate reading underlying papers. The apparatus includes an anchor portion sized to be inserted through and anchored within a bound region of the folder, and a page-retaining portion that projects upwardly and forwardly from the anchor portion for holding back papers when the anchor is anchored within the bound region. A method for holding back papers is also disclosed.

27 Claims, 8 Drawing Sheets

FILE PAPER RETAINER AND METHOD

TECHNICAL FIELD

The present invention relates generally to office supplies. More particularly, the present invention relates to devices for holding back papers to facilitate reading of the papers.

BACKGROUND

The present invention relates to an apparatus for retaining and supporting multiple sheets of paper bound in a file folder to allow the user easier viewing of papers located beneath the retained and supported papers. Difficulties arise when a user of a file folder attempts to hold a place open in a file folder for review. The current remedy to this problem is the use of a weighted object placed on top of papers filed in the top of a file folder while viewing papers located underneath. When the weight is placed on the top papers, the lower papers tend to shift and curve toward the weighted papers, making them difficult to read. Another weight can be placed on the lower papers and if balanced correctly, can help the user in keeping the pages where desired. This presents the problem of viewing material located under the weight that has been placed on the lower papers. In order to view material located beneath the weight, more shifting and balancing of the weights is required.

SUMMARY

The present invention is directed toward apparatuses and methods for holding back papers in a file folder to facilitate viewing of underlying papers bound within the file folder.

DETAILED DESCRIPTION

Various inventive aspects of the present disclosure relate to devices for holding back papers bound within file folders to facilitate reading underlying papers. Devices in accordance with the principles of the present disclosure preferably allow papers bound in the folder to be held back in a hands-free manner to allow the person reading the underlying paper to use their hands for other activities such as writing, typing, highlighting or other like activities.

File folders typically have either a single-fold or a two-fold configuration. A single-fold file folder typically has two panels separated by a fold. Papers are bound to one of the panels. Typically, papers are bound to the panel by punching holes through the papers, and using a binding structure to fasten the papers to the panel. Most commonly, the papers are two-hole punched adjacent their top edge and bound to the panel by a clip or other retainer that passes through the punched holes. The binding mechanism can be any number of configurations such as clips, straps, screw-in plate configurations, Velcro straps, or other structures.

Two-fold folders typically have three panels separated by the folds. Papers are often secured to each of the panels of a two-fold folder. The papers are secured to each of the panels by binding techniques similar to those described above with respect to single-fold file folders. For example, papers are typically two-hole punched and secured to the panels by fastening mechanisms having members that extend through the punched holes. The fastening mechanisms can be opened and closed adjacent the top side of the uppermost sheet of paper being bound to facilitate adding papers to the folder or removing papers from the folder.

Figure 1:
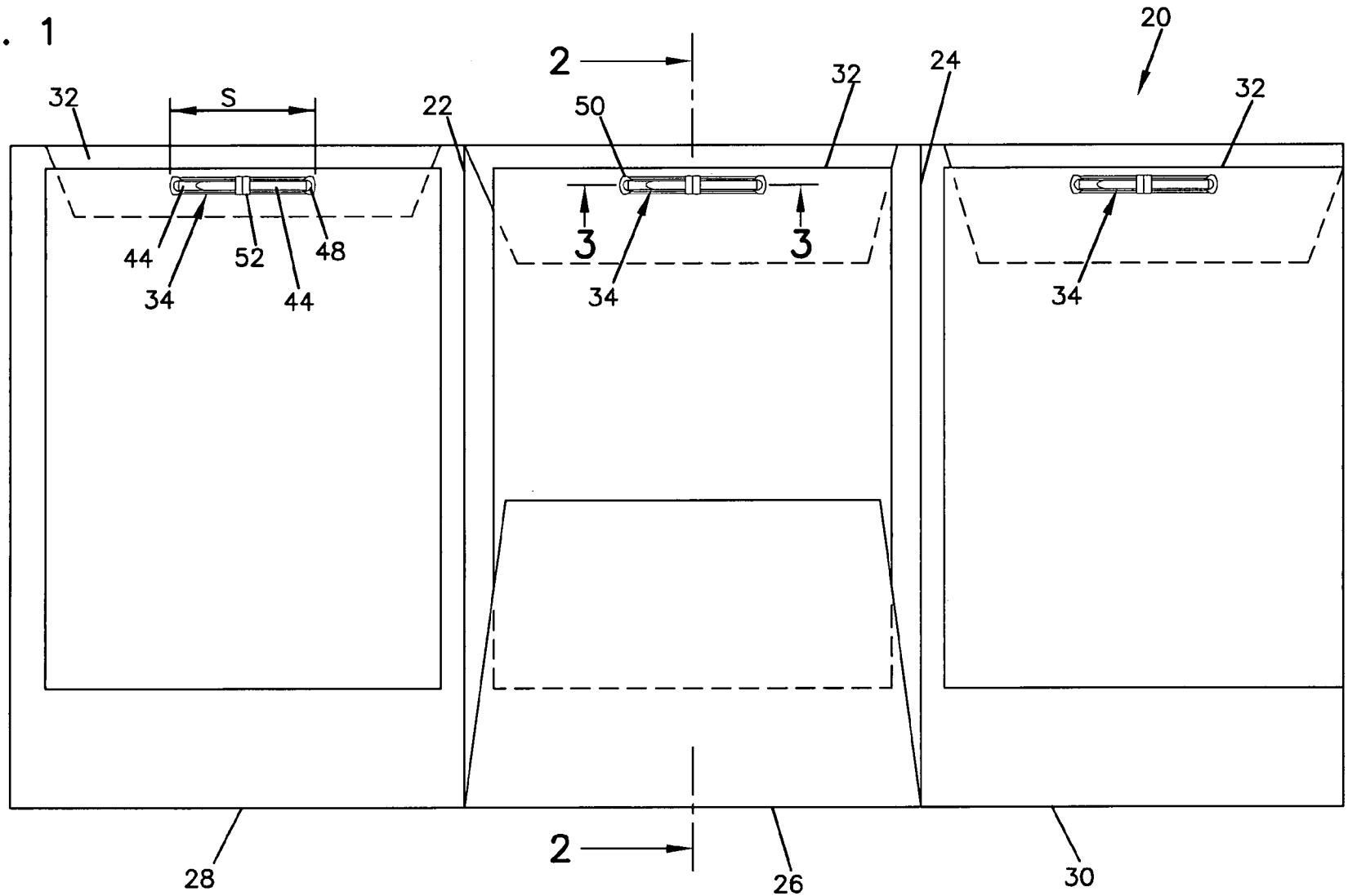
FIG. 1 is a plan view of a two-fold file folder.

FIG. 1 shows one example of a two-fold file folder 20 for which file paper retaining devices in accordance with the principles of the present disclosure could be used. The folder 20 includes first and second folds 22 and 24. Fold 22 separates a center panel 26 from a left panel 28. Fold 24 separates the center panel 26 from a right panel 30. Stacks of papers 32 are bound to each of the panels 26, 28 and 30 by conventional fasteners 34.

Figure 2:
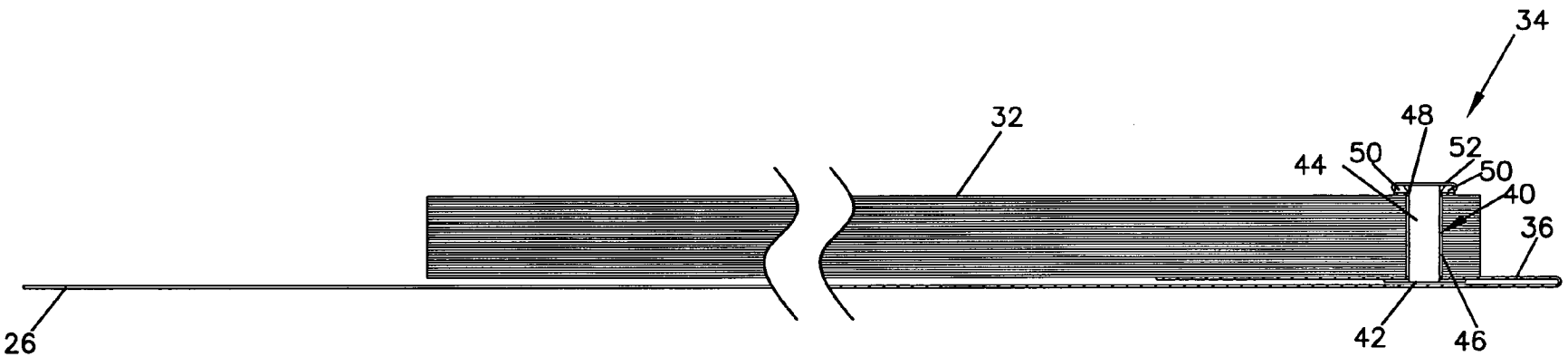
FIG. 2 is a cross-sectional view taken along section line 2-2 of FIG. 1.
Figure 3:
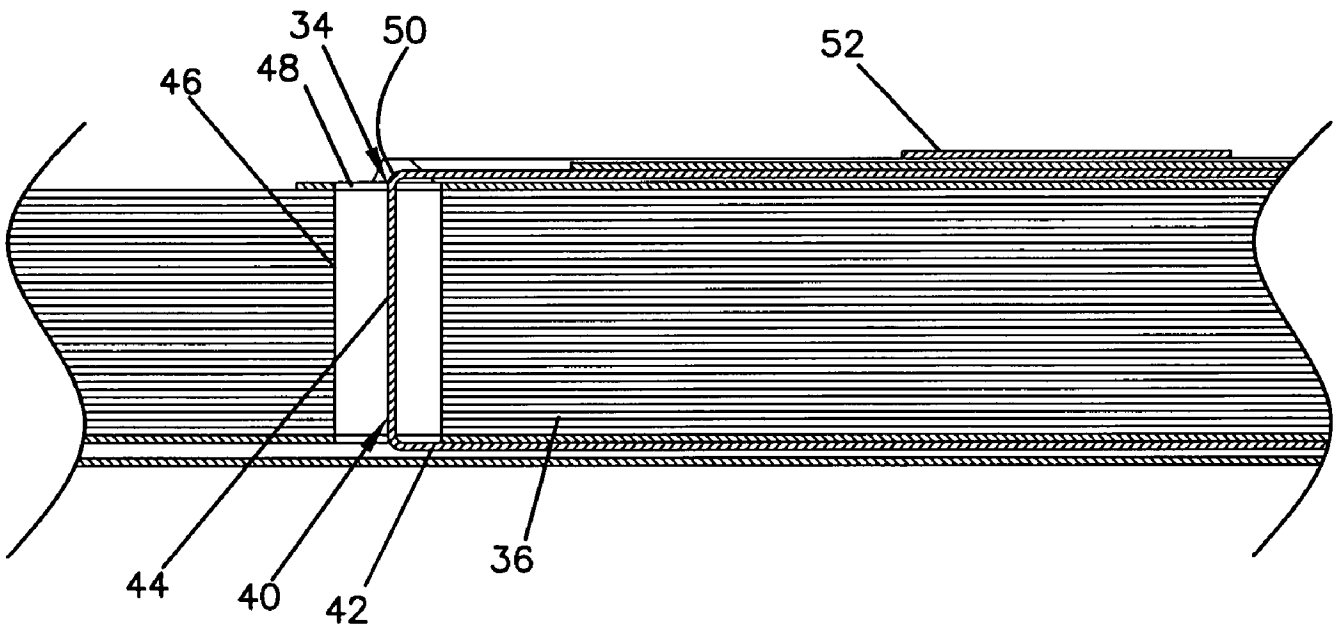
FIG. 3 is a cross-sectional view taken along section line 3-3 of FIG. 1.

A binding arrangement using one of the fasteners 34 to secure papers to the central panel 26 is depicted in FIGS. 2 and 3. It will be appreciated that the left and right panels 28 and 30 can include similar binding arrangements as the central panel 26. It will also be appreciated that paper retaining devices in accordance with the principles of the present disclosure can be used to hold back papers bound by the depicted binding arrangement, and can also be used to hold back papers bound by other file folder binding configurations.

Referring to FIGS. 2 and 3, the fastener 34 of the binding arrangement is configured to secure the papers 32 to a paper securement flap 36 positioned at a top edge of the panel 26. The fastener 34 includes a flexible metal clip 40 having a base portion 42 located beneath the flap 36 and legs 44 routed upwardly through holes 46 defined by the flap 36 and the papers 32. The holes 46 in the papers are typically provided by punching the holes through the papers with a standard two-hole punch. Conventionally, the spacing s (see FIG. 1) between holes formed by a two-hole punch is about 2.5 inches.

The legs 44 of the clip 40 are routed upwardly through the punched holes 46 and inserted through holes 48 defined by a top retaining piece 50. The top-retaining piece 50 is placed over the uppermost piece of paper with the holes 48 aligned with the holes 46 of the papers. The legs 44 are passed through the holes 46 and bent inwardly and downwardly against the retaining piece 50. Slide retainers 52 can be slid over the ends of the legs 44 to prevent the legs 44 from slipping through the holes 46 and to tightly bind the top portions of the paper 34 together.

A problem with papers retained within a file folder is that it is difficult to read underlying pieces of paper in the stack without manually holding back the papers above the paper desired to be read. If the papers above the paper desired to be read are merely folded back, the papers have a tendency to fall forward absent being manually held in place. In reading files, it is also often necessary for the reader to use their hands for other functions such as typing or writing. Therefore, it is not convenient to manually hold the papers back. The present invention provides devices for holding back papers in a file folder so that a reader can read underlying papers without having to manually hold back the overlying papers. Preferably, devices in accordance with the principles of the present disclosure hold back papers without covering substantial portions of the paper desired to be read.

Figure 5:
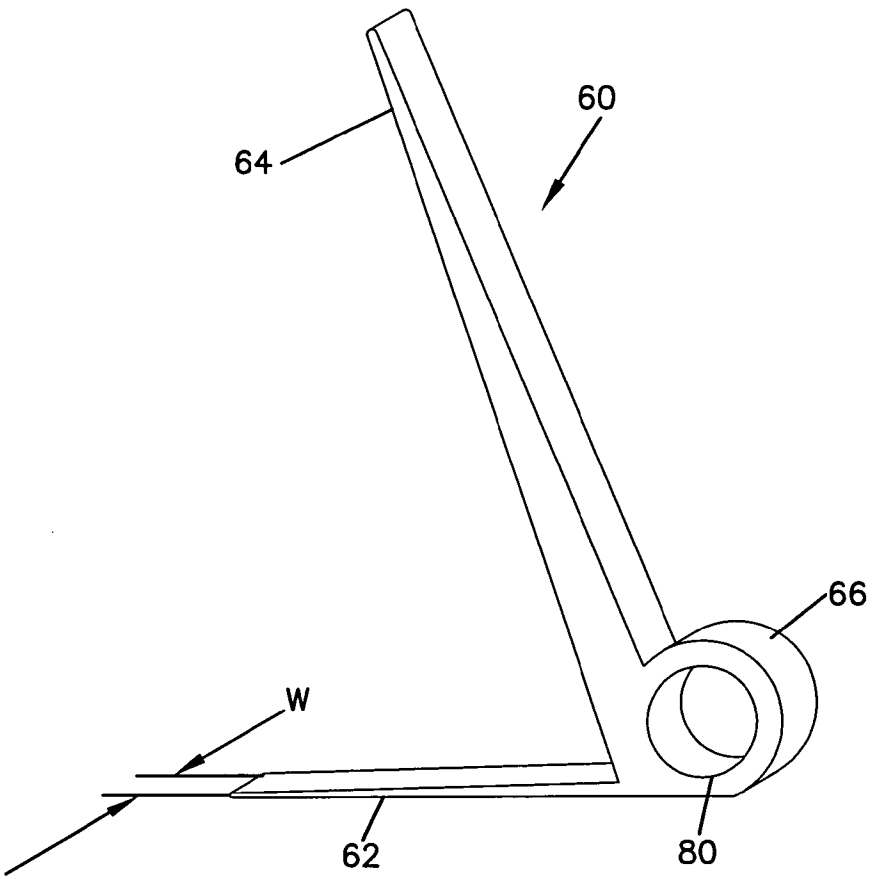
FIG. 5 is a perspective view of the paper retainer of FIG. 4.
Figure 4:
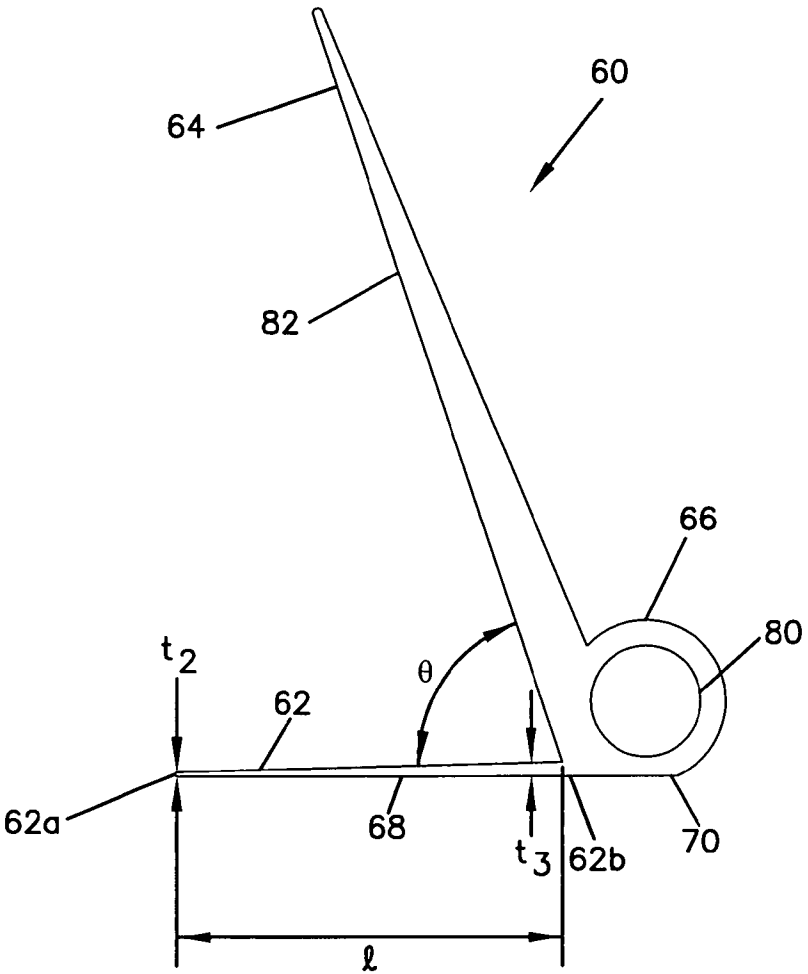
FIG. 4 is a side view of a paper retainer having features that are examples of inventive aspects in accordance with the principles of the present disclosure.
Figure 6:
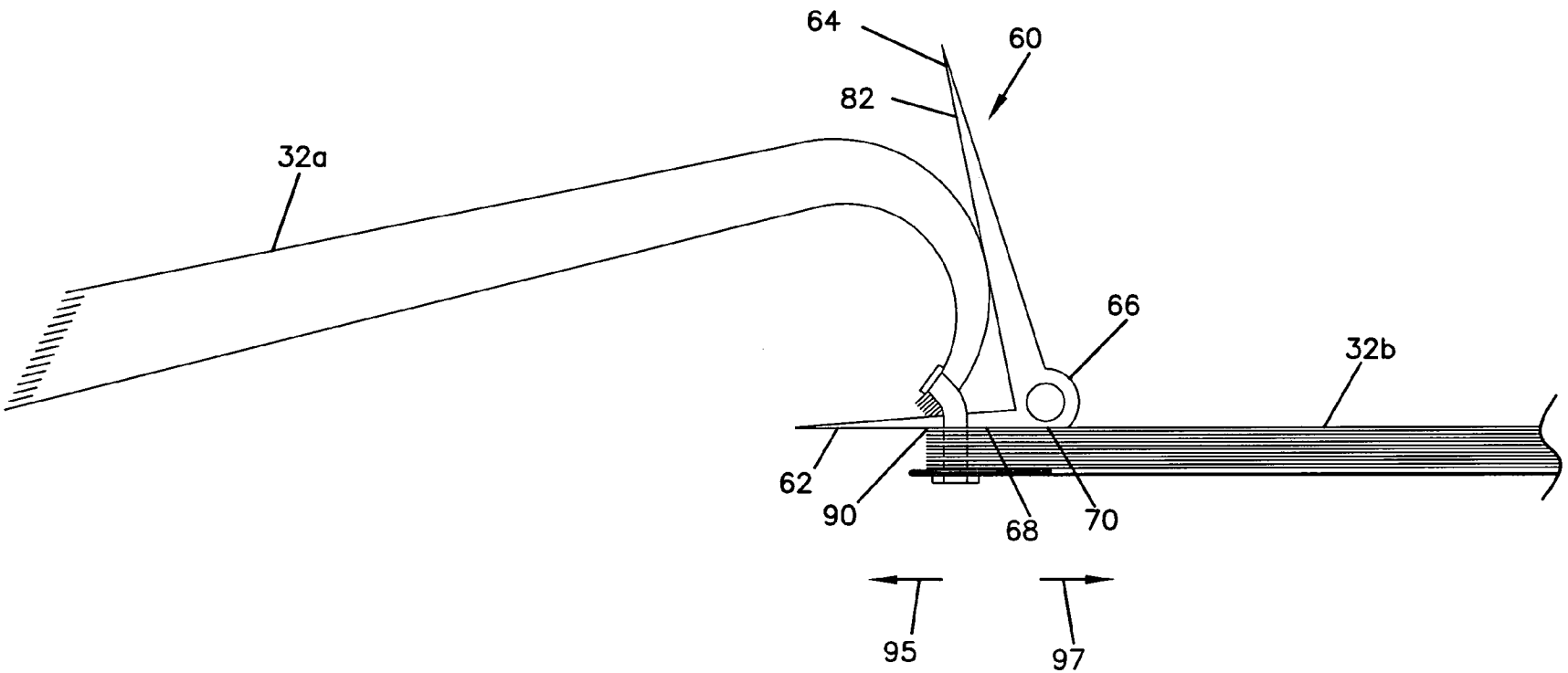
FIG. 6 illustrates the paper retainer of FIGS. 4 and 5 being used to hold back papers of a file.

FIGS. 4 and 5 illustrate a file paper retainer 60 having features that are examples of inventive aspects in accordance with the principles of the present disclosure. The paper retainer 60 includes an anchor 62 adapted to be inserted through the bound region of the stack of papers 32. The paper retainer also includes a page-retaining portion 64 that projects upwardly from the anchor 62. The page-retaining portion 64 is adapted to hold back papers that would otherwise overlie a piece of paper desired to be read. The file paper retainer 60 further includes a handle or grip 66 adapted for facilitating inserting the anchor 62 into the bound region of the papers and for facilitating removing the anchor 62 from the bound region. The anchor 62 is preferably sized and shaped to be inserted through the bound region of the stack of papers (as shown in FIG. 6) and retained in place by friction or other means.

Referring to FIG. 4, the anchor 62 preferably has a length l that is sufficiently long to allow the anchor 62 to be inserted into the bound region when the paper-retaining portion 64 is in contact with the papers desired to be held back. In one embodiment, the length l is greater than 1.5 inches. In another embodiment, the length l is greater than 2 inches. In still another embodiment, the length l is equal to or greater than 2.5 inches. In still another embodiment, the length l is in the range of 2 to 5 inches. In a further embodiment, the length l is in the range of 2.5 to 4 inches.

Referring still to FIG. 4, the anchor 62 preferably has a first thickness t1 that is sufficiently thin to allow the anchor 62 to be inserted through the bound region even when the papers are relatively tightly bound. In one embodiment, the thickness t1 is in the range of 0.5 to 2 cm. In another embodiment, the thickness t1 is in the range of 0.5 to 1 cm. In still other embodiments, the thickness t1 is less than 3 cm or less than 2 cm. To facilitate insertion of the anchor 62 into the bound region, the anchor 62 can have a tip thickness t2 that is less than the thickness t1. For example, in certain embodiments, the anchor can have a ramped or tapered configuration such that the thickness increases as the anchor 62 extends from a free end 62*a* to a base end 62*b*.

As depicted in the embodiment of FIG. 4, the underside of the anchor 62 defines a stabilization surface 68. When the anchor 62 is inserted into the bound region during use, the stabilization surface 68 faces the top side of the paper desired to be read. As the page retaining portion 64 engages and holds back the stack of papers overlying the paper desired to read, pressure is applied to the page retaining portion 64 causing the stabilization surface to be forced downwardly against the top side of the piece of paper being read. In this manner, the stabilization surface provides stabilization that prevents the page-retaining portion 64 from being forced downwardly by the papers being retained by the page-retaining portion. Stabilization is further augmented by an extended stabilization surface 70 defined beneath the handle 66. The extended stabilization surface 70 extends rearwardly of the page-retaining portion 64.

Referring still to FIG. 4, the page-retaining portion 64 is preferably oriented relative to the anchor 62 in a configuration that allows the page-retaining portion 64 to hold back papers when the anchor is anchored within a given file folder. The papers are preferably held back in such a way to allow the reader to readily read the piece of paper underlying the anchor 62. In one embodiment, the page-retaining portion 64 is aligned at an angle θ in the range of 45 to 135 degrees relative to the anchor 62. In another embodiment, the angle θ is in the range of 60 to 120 degrees. In still another embodiment, the angle θ is in the range of 70 to 105 degrees. In a further embodiment, the angle θ is in the range of 70 to 90 degrees. In still another embodiment, the angle θ is less than 90 degrees or less than 85 degrees.

Figure 7:
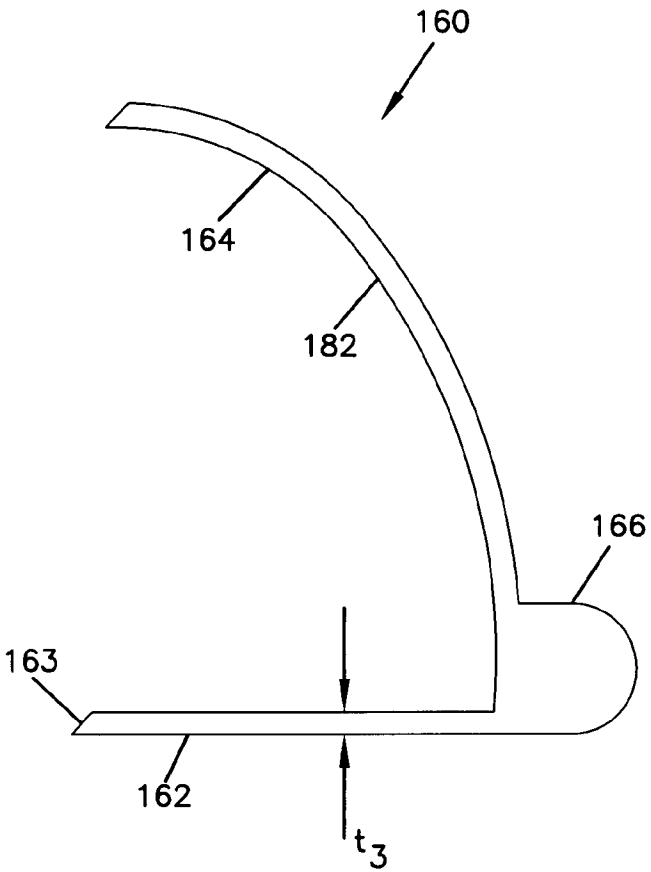
FIG. 7 is a side view of a second paper retainer having features that are examples of inventive aspects in accordance with the principles of the present disclosure.

The page-retaining portion 64 also includes a page-retaining surface 82 adapted to engage the underside of the bottommost piece of paper of the stack of papers desired to be held back. The page-retaining surface 82 can be planar as shown in the embodiment of FIG. 4, or curved as shown in the embodiment of FIG. 7.

Referring to FIG. 5, the anchor 62 of the file paper retainer 60 preferably has a width W less than the spacing s between holes made a standard two-hole punch. Thus, the width W is preferably less than or equal to 2.5 inches. Furthermore, in certain embodiments, it is desirable for the width W to be relatively small to minimize the amount of text that may possibly be covered by the file paper retainer 60. Therefore, in certain embodiments, the width W is less than 1.5 inches, or less than 1 inch. In one embodiment, the width W is in the range of .25 to 1.5 inches.

The file paper retainer 60 can be manufactured from any number of materials. Example materials include metal, plastic, rubber, acrylic, polycarbonate or wood. In one embodiment, the retainer 60 is made of a metal material such as aluminum. In a preferred embodiment, the retainer 60 is made of a transparent plastic material that allows text covered by the retainer to be read through the retainer 60.

Referring again to FIGS. 4 and 5, the handle 66 projects rearwardly from the anchor 62 and the page-retaining portion 64. The handle 66 is preferably configured to be readily manually gripped. For example, as shown in the embodiment of FIG. 4, the handle includes a finger opening 80, sized to receive a user's index finger to facilitate insertion of the anchor 62 into the bound region, and also to facilitate removal of the anchor 62 from the bound region.

As indicated above, the page retaining device 60 is adapted to hold back papers in a hands-free manner so that underlying papers can be readily read while conducting other manual activities such as typing or underlining. To use the device 60, a stack of papers 32*a* desired to be held back is manually folded back as shown in FIG. 6 such that an underlying paper 32*b* desired to be read is exposed. With the stack of papers 32*a* manually held back, the anchor 62 of the device 60 is inserted into a nip 90 defined between the stack of papers 32*a* and the paper 32*b*. Nip 90 is located at the bound region of the papers 32. Preferably, the anchor 62 is inserted completely through the bound region and is frictionally held in place. The anchor 62 can be inserted into the bound region by placing the device with the stabilization surface 68 on the top side of paper 32*b* and the page-retaining portion 64 projecting upwardly, and then sliding the device 60 forwardly (indicated by direction arrow 95) until the anchor 62 passes through the bound region, and the page-retaining portion 64 engages the underside of the lowermost paper of the stack of papers 32*a*. The stack of papers 32*a* can then be released. Upon release of the papers 32*a*, papers have a tendency to fall rearwardly, which causes the papers to abut against the page retaining surface 82 of the page-retaining surface 64. As the papers 32*a* press against the page-retaining portion 64, the anchor 62 and the stabilization surfaces 68, 70 cooperate to stabilize and reinforce the page-retaining portion 64 such that the papers 32*a* are prevented from falling back over the paper 32*b*. Once the paper 32*b* is read, the handle 66 can be grasped and used to pull the device 60 rearwardly (indicated by direction arrow 97) to remove the anchor 62 from the bound region. Thereafter, the paper 32*b* can be flipped upwardly to join the stack of papers 32*a*, and the retainer 60 can be reinserted into the bound region to facilitate reading the next page.

FIG. 7 illustrates an alternative page retainer 160 having features that are examples of inventive aspects in accordance with the principles of the present disclosure. The device 160 includes an anchor 162 and a page-retaining portion 164 that projects upwardly from the anchor 162. The anchor 162 includes a beveled front end 163 to facilitate insertion of the anchor into a bound region of a stack of papers. The remainder of the anchor 162 has a thickness t3 that is generally constant and comparable to the thickness t1 described with respect to the embodiment of FIG. 4. The device 160 also includes a handle 166 that does not include a finger opening. The page-retaining portion 164 of the device 160 has a page-retaining surface 182 that curves with a convex curvature as the page-retaining surface angles upwardly and forwardly from the anchor 162.

Figure 8:
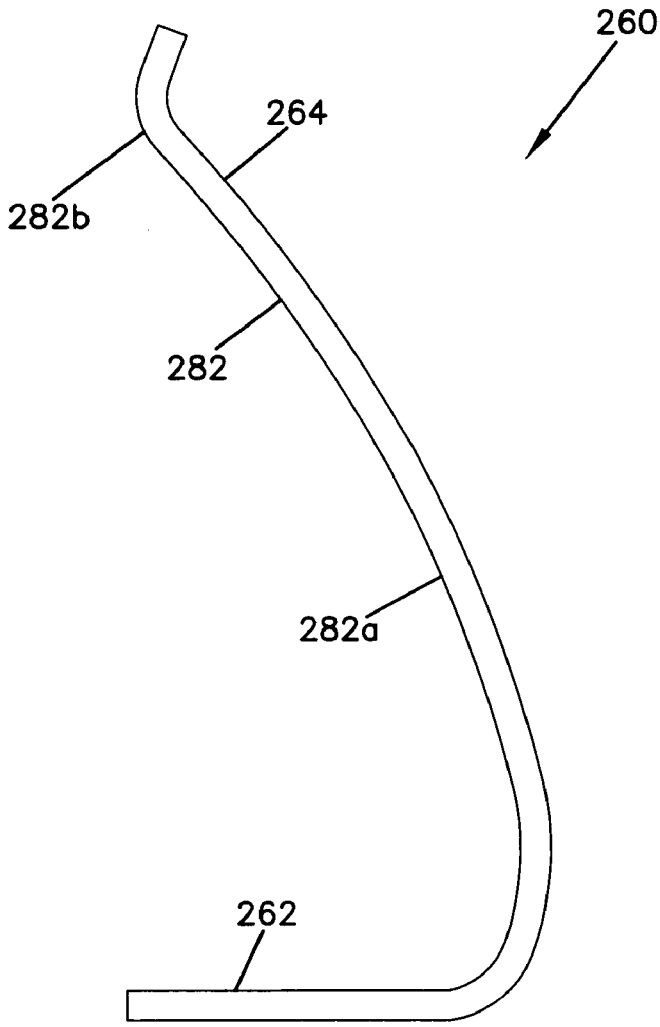
FIG. 8 is a side view of a third paper retainer having features that are examples of inventive aspects in accordance with the principles of the present disclosure.
Figure 9:
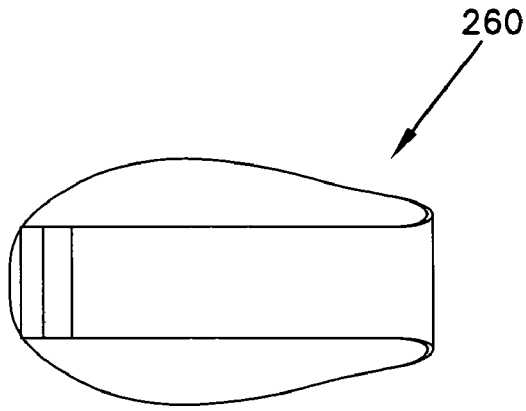
FIG. 9 is a top plan view of the paper retainer of FIG. 8.
Figure 10:
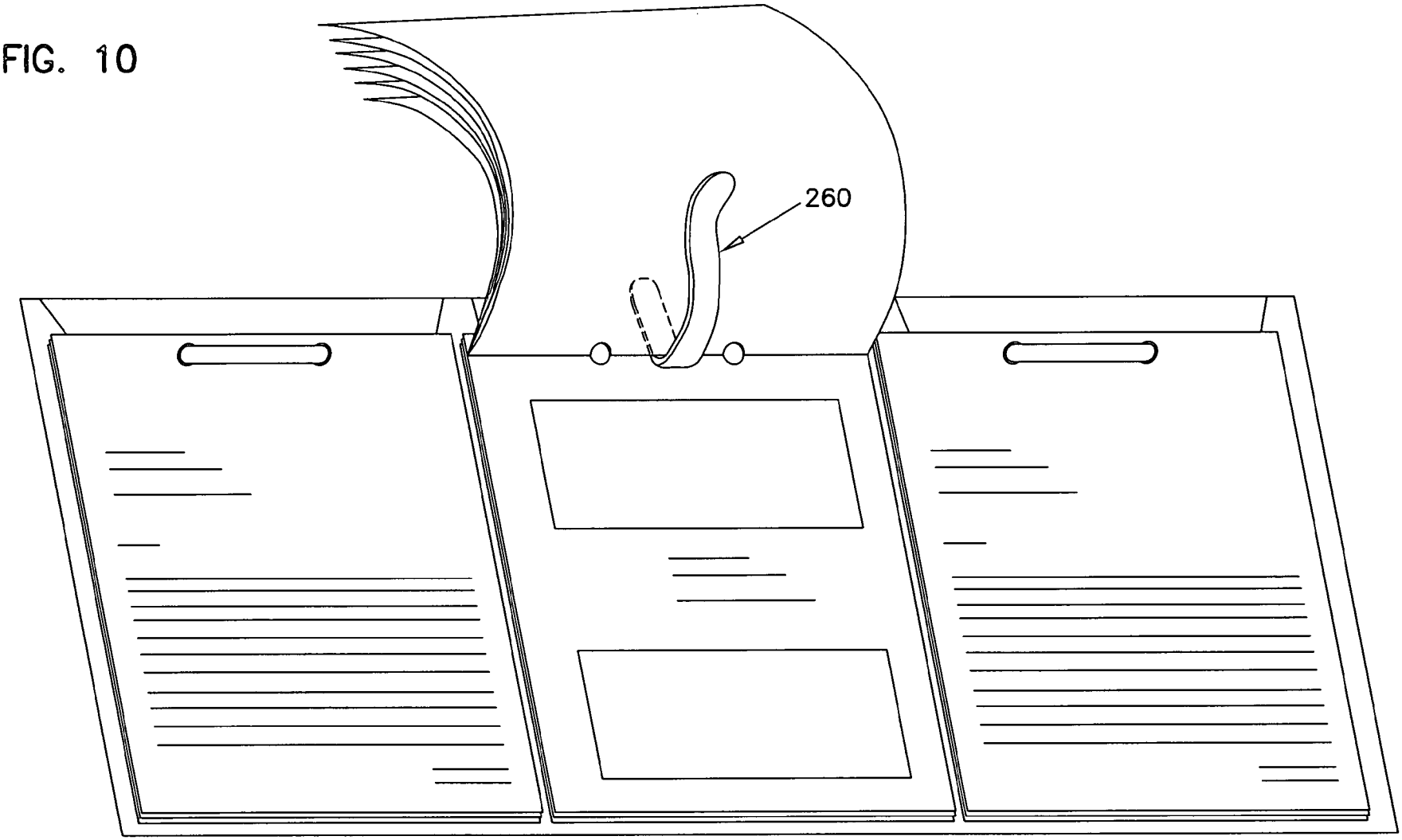
FIG. 10 illustrates the paper retainer of FIGS. 8 and 9 being used to hold back papers of a file.

FIGS. 8-10 illustrate another page retainer 260 having features that are examples of inventive aspects in accordance with the principles of the present disclosure. The page retainer 260 includes an anchor 262 and a page-retaining portion 264. Unlike previous embodiments, the page retainer 260 does not include an auxiliary stabilizing portion that extends rearwardly of the page-retaining portion 264, or a separate handle.

The device 260 is used in a similar manner as the previously described embodiment (as shown in FIG. 10). However, rather than grabbing a handle, the user grasps the side edges of the retaining portion 264 when inserting the anchor 262 into the bound region or when removing the anchor 262 from the bound region. The page-retaining portion 264 includes a page-retaining surface 282 having a first portion 282*a*, having a concave curvature that angles upwardly and forwardly from the base end of the anchor 262. The page retaining surface 282 transitions from the concave portion 282*a* adjacent the bottom of the page retaining portion 264 to a convex portion 282*b* located adjacent the top end of the page-retaining portion 264.

Figure 11:
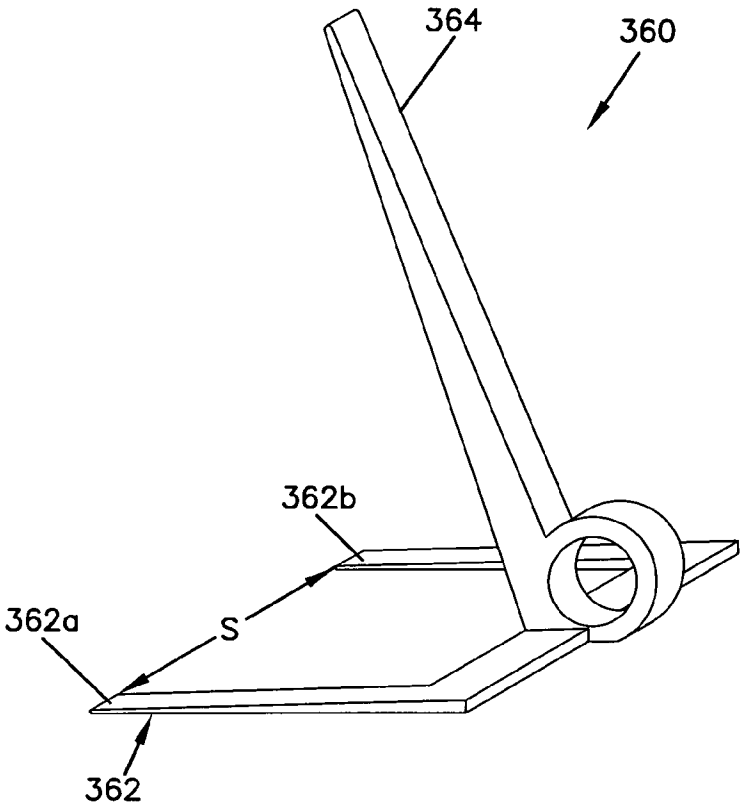
FIG. 11 is a perspective view of a third paper retainer having features that are examples of inventive aspects in accordance with the principles of the present disclosure.

FIG. 11 illustrates still another page-retainer 360 having features that are examples of inventive aspects in accordance with the principles of the present disclosure. The page retainer 360 includes an anchor 362 and a page-retaining portion 364. The anchor 362 includes two spaced-apart legs 362*a*, 362*b* separated by a spacing s that is preferably greater than the spacing between two standard two-hole punch holes. Thus, when used with a file folder, the anchor 362 can be inserted into the bound region of a file such that the legs 362*a*, 362*b* straddle and are located outside of the two-hole punched region of the folder.

Various modifications and alterations of this invention will be apparent to those skilled in the art without departing from the scope and spirit of this invention. It should be understood that this invention is not limited to the illustrative embodiments set forth above.

I claim:

1. A method for holding back papers in a file folder by using a paper retainer, the paper retainer including an anchor portion and a page-retaining portion, the papers being bound within the file folder at a bound region by a fastening structure that extends through holes in the papers, the papers each having a length and a width, the lengths of the papers extending between top and bottom edges of the papers, the holes being located adjacent the top edges of the papers, the method comprising:

lifting one or more of the bound papers;

inserting the anchor portion beneath the one or more lifted papers and through the bound region of the file folder with the page-retaining portion extending upwardly from the anchor portion to support the one or more lifted papers such that the lifted papers are prevented from covering a subsequent paper in the file folder desired to be read, wherein the anchor portion is inserted through the bound region in an insertion direction that is generally parallel to the lengths of the papers, and wherein the anchor portion is moved along a front surface of the subsequent paper during insertion and the insertion direction is generally parallel to the front surface of the subsequent paper.

2. The method of claim 1, wherein the paper retainer includes a handle, wherein the handle has a vertical thickness that is substantially larger than a corresponding vertical thickness of the anchor portion, and wherein the anchor portion of the paper retainer is inserted through the bound region with the assistance of the handle.

3. The method of claim 2, wherein the handle includes a stabilization surface that engages the subsequent paper in the file folder to stabilize the paper retainer, wherein the anchor portion has a first length measured along the direction of insertion, wherein the handle has a second length measured along the direction of insertion, and wherein the first length is substantially longer than the second length.

4. The method of claim 1, wherein the anchor has a thickness less than 3 centimeters and a length measured along the direction of insertion that is greater than 1.5 inches.

5. The method of claim 1, wherein the anchor has a length measured along the direction of insertion that is greater than or equal to 2.5 inches.

6. The method of claim 1, wherein the anchor has a thickness in the range of 0.5-1 centimeters.

7. The method of claim 1, wherein the anchor has a thickness that tapers along at least a majority of a length of the anchor portion.

8. The method of claim 1, wherein the anchor includes an insertion tip that is beveled.

9. The method of claim 1, wherein the page-retaining portion is aligned at an angle less than 90 degrees relative to the anchor portion.

10. The method of claim 1, wherein the page-retaining portion is aligned at an angle less than 85 degrees relative to the anchor portion.

11. The method of claim 1, wherein the page-retaining portion is aligned at an angle in the range of 45-135 degrees relative to the anchor portion.

12. The method of claim 1, wherein the papers bound in the file folder are two hole punched, and wherein the anchor portion is inserted through the bound region at a location between the two holes.

13. The method of claim 1, wherein the papers bound in the file folder are two hole punched, and wherein the anchor portion has legs that straddle the two holes.

14. The method of claim 1, wherein the paper-retaining portion is curved.

15. The method of claim 1, wherein the paper-retaining portion includes a concave portion and a convex portion.

16. The method of claim 1, wherein the anchor portion is inserted through the bound region by grasping lateral edges of the paper retainer.

17. The method of claim 1, wherein the paper retainer is transparent.

18. The method of claim 1, wherein the holes are separated by a spacing of about 2.5 inches.

19. An apparatus for holding back papers in a folder to facilitate reading underlying papers, the apparatus comprising:

an anchor portion sized to be inserted through and anchored within a bound region of the folder;

a page-retaining portion that projects upwardly from the anchor portion for holding back papers when the anchor is anchored within the bound region;

the anchor portion extending forwardly from a base of the page-retaining portion, the anchor portion having a first length measured in a forward direction from the base of the page-retaining portion;

a handle for facilitating inserting and removing the anchor portion from the bound region, the handle extending rearwardly from the base of the page-retaining portion, the handle having a second length measured rearwardly from the base of the page-retaining portion, the first length being substantially longer than the second length and wherein the handle includes opposite sides, and wherein the opposite sides include recessed regions for facilitating grasping the handle; and the handle having a vertical dimension that is substantially larger than a corresponding vertical dimension of the anchor portion.

20. The apparatus of claim 19, wherein the vertical dimension of the anchor portion tapers along at least a majority of the first length of the anchor portion.

21. The apparatus of claim 19, wherein anchor portion and the handle have bottom surfaces that are co-planar along the first and second lengths.

22. The apparatus of claim 19, wherein the first length is at least twice as long as the second length, and wherein the vertical dimension is at least twice as large as the corresponding vertical dimension of the handle.

23. The apparatus of claim 19, wherein the recessed regions are defined by a hole that extends through the handle between the opposite sides.

24. The apparatus of claim 19, further comprising means to facilitate grasping the handle.

25. The apparatus of claim 19, wherein the apparatus has a plastic construction.

26. The apparatus of claim 19, wherein the anchoring portion, the handle and the page-retaining portion are all aligned along a single plane.

27. The apparatus of claim 19, wherein the page-retaining is aligned at an angle less than 90 degrees relative to the anchor portion.

* * * * *